US011167406B2

(12) United States Patent
Peer

(10) Patent No.: US 11,167,406 B2
(45) Date of Patent: Nov. 9, 2021

(54) APPARATUS FOR STORING AND ORGANIZING UTILITY TOOLS

(71) Applicant: Roy Peer, Riverview, FL (US)

(72) Inventor: Roy Peer, Riverview, FL (US)

( * ) Notice: Subject to any disclaimer, the term of this patent is extended or adjusted under 35 U.S.C. 154(b) by 0 days.

(21) Appl. No.: 17/223,296

(22) Filed: Apr. 6, 2021

(65) Prior Publication Data

US 2021/0229263 A1 Jul. 29, 2021

Related U.S. Application Data

(60) Provisional application No. 63/115,217, filed on Nov. 18, 2020.

(51) Int. Cl.
*A47F 7/00* (2006.01)
*A47B 87/02* (2006.01)
*B25H 3/04* (2006.01)

(52) U.S. Cl.
CPC ..... *B25H 3/04* (2013.01)

(58) Field of Classification Search
CPC ..... B25H 3/04; A47F 7/0028; A47B 87/0223; A47B 87/0246; A47B 47/045
See application file for complete search history.

(56) References Cited

U.S. PATENT DOCUMENTS 3,281,102 A * 10/1966 Hobson ..... A47B 57/42 248/125.3
3,719,408 A * 3/1973 Fullington ..... A47F 3/00 312/236
5,011,028 A * 4/1991 Sweeney ..... A47F 7/0028 211/207
5,810,177 A * 9/1998 Cabiran ..... B25H 3/04 211/70.6
5,833,250 A * 11/1998 Schier ..... B62B 1/22 280/47.19
5,971,174 A * 10/1999 Strock ..... A47B 87/008 211/186
D429,071 S * 8/2000 Hurt ..... D3/315
6,202,867 B1 * 3/2001 Di Blasi ..... A47B 47/0075 108/138
6,230,985 B1 * 5/2001 Wang ..... B05B 15/65 239/273
6,695,153 B1 * 2/2004 Chao ..... A47B 81/00 211/60.1
6,796,440 B2 * 9/2004 Wang ..... A47F 7/0028 211/183
6,983,854 B2 * 1/2006 Pleiman ..... B25H 3/04 211/70.6
7,063,218 B2 * 6/2006 Pleiman ..... B25H 3/04 211/70.6

(Continued)

*Primary Examiner* — Kimberley S Wright
(74) *Attorney, Agent, or Firm* — Barry Choobin; Patent 360

(57) ABSTRACT

An apparatus for storing utility tools in an organized manner, in particle tools with long handles. The apparatus having an upper panel, a lower panel, and three pillars that extend between the upper panel and the lower panel. Each the upper panel and the lower panel having voids for different dimensions and shapes. Such voids of the different dimensions and shapes can receive a range of tools of different shapes and dimensions. The pillars having peg holes throughout that can be used to mount hooks. A range of articles can be mounted to these hooks.

8 Claims, 7 Drawing Sheets

(56) References Cited

U.S. PATENT DOCUMENTS

| | | | | |
|---|---|---|---|---|
| 7,427,053 | B2 * | 9/2008 | Nawrocki | A47F 5/0006 211/57.1 |
| 8,141,723 | B2 * | 3/2012 | Whalen | A47F 5/0043 211/135 |
| 8,695,816 | B2 * | 4/2014 | Troyner | A47B 96/14 211/191 |
| 9,033,164 | B2 * | 5/2015 | Troyner | A47B 57/402 211/191 |
| 9,474,370 | B2 * | 10/2016 | Troyner | A47F 5/0807 |
| 10,709,238 | B1 * | 7/2020 | Thompson | A47B 87/0223 |
| 2001/0047970 | A1 * | 12/2001 | McBride | A47B 91/02 211/85.11 |
| 2003/0234230 | A1 * | 12/2003 | Wang | A47F 7/0028 211/70.6 |
| 2004/0118796 | A1 * | 6/2004 | Chen | A47B 81/00 211/70.6 |
| 2004/0188367 | A1 * | 9/2004 | Pleiman | B25H 3/04 211/70.6 |
| 2006/0000789 | A1 * | 1/2006 | Pleiman | B25H 3/04 211/70.6 |
| 2007/0114348 | A1 * | 5/2007 | Nawrocki | A47F 5/0006 248/220.21 |
| 2008/0053940 | A1 * | 3/2008 | Whalen | A47B 47/045 211/134 |
| 2008/0128319 | A1 * | 6/2008 | Noble Colin | A47B 57/20 206/745 |
| 2009/0014400 | A1 * | 1/2009 | Nawrocki | A47F 5/0006 211/90.03 |
| 2015/0335173 | A1 * | 11/2015 | Lee | A47B 47/0083 211/188 |

* cited by examiner

APPARATUS FOR STORING AND ORGANIZING UTILITY TOOLS

CROSS-REFERENCE TO RELATED APPLICATIONS

This application claims priority to the U.S. provisional patent application Ser. No. 63/115,217, filed on Nov. 18, 2020, which is incorporated herein by reference in its entirety.

FIELD OF INVENTION

The present invention relates to a utility tools rack, and more particularly, the present invention relates to a pegboard modular long handle tools rack for storage and organization of long handle tools.

BACKGROUND

Toolboxes and racks are known in the art for use in storing and organizing handheld tools, such as pliers, wrenches, screwdrivers, and like. Such boxes may also have options to store screws. Many of the tools of general use have long handles. For example, gardening tools, such as trowel and rake have long handles. Such long tools cannot be accommodated in the known toolboxes. Generally, such long tools are stowed in corners against the wall. Also, it is common for such tools to be hung on the wall or through a hook descended from a vertical support. However, such an arrangement of storing the tools is untidy, unorganized, and often the tools may fall.

Thus, a desire is there for an apparatus that can be used to organize and store the long handle tools.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus for storing and organizing long-handle utility tools.

It is another object of the present invention that the apparatus provides stable storage of the tools.

It is still another object of the present invention that the apparatus can be used to store tools for varying shapes and sizes.

It is yet another object of the present invention that the apparatus can be easily assembled and disassembled for storage and transport.

It is a further object of the present invention that the apparatus can provide for storing small and medium-size tools.

It is still a further object of the present invention that the apparatus can be easily customized.

In one aspect, disclosed is an apparatus for storing utility tools in an organized manner. The disclosed apparatus having an upper panel, a lower panel, and three pillars that extend between the upper panel and the lower panel. Each the upper panel and the lower panel having voids of different dimensions and shapes. Such voids of the different dimensions and shapes can receive a range of tools of different shapes and dimensions.

In one aspect, the apparatus can have voids of different dimensions and shapes for the tool handles to enter that vary in shape and size allowing for more stable storage and support.

In one aspect, the modularity of the design utility allows multiple units of apparatuses to be able to expand in the horizontal and vertical plane with the interlocking lower panel and upper panel pieces and with a typical friction port for structural pieces to enter from above and below, respectively.

In one aspect, the pillars can have a pegboard surface to which standard market peg hooks and other accessories can be arranged. Hooks can be installed for hanging small and medium-size tools. The hooks can also be used to create the structure for shelves to sit on top of two or more hooks.

In one aspect, the periphery of the voids can be tapered that smothers the entry of a tool into the void. The voids having an underlying extrusion that also works as a structural column when touching the ground on the lower panel. The height of the upper panel and the lower panel also provides structural anti-fall support, giving the whole apparatus more stability when tools lean towards the front side of the rack. Additional support underneath the triangulated face gives the apparatus more support as the weight of the tool increases. A lip can be added to the front of the triangulated piece to allow for smaller hand tools to rest there for easier access. This lip also allows for increased floor support.

In one aspect, twelve units of the apparatus can be combined side-by-side to form a bigger assembly. Moreover, six more panels can be added on top of the upper panel without significantly affecting the stability of the assembly. The assembly can grow vertically to even larger heights as needed by the consumer. Each apparatus can also include support holes for wall mounting screws. Two units of apparatuses can be coupled using nut and bolt for additional support as well as mounted to the wall through the multiple holes specifically implemented for wall mounting and wall screws.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
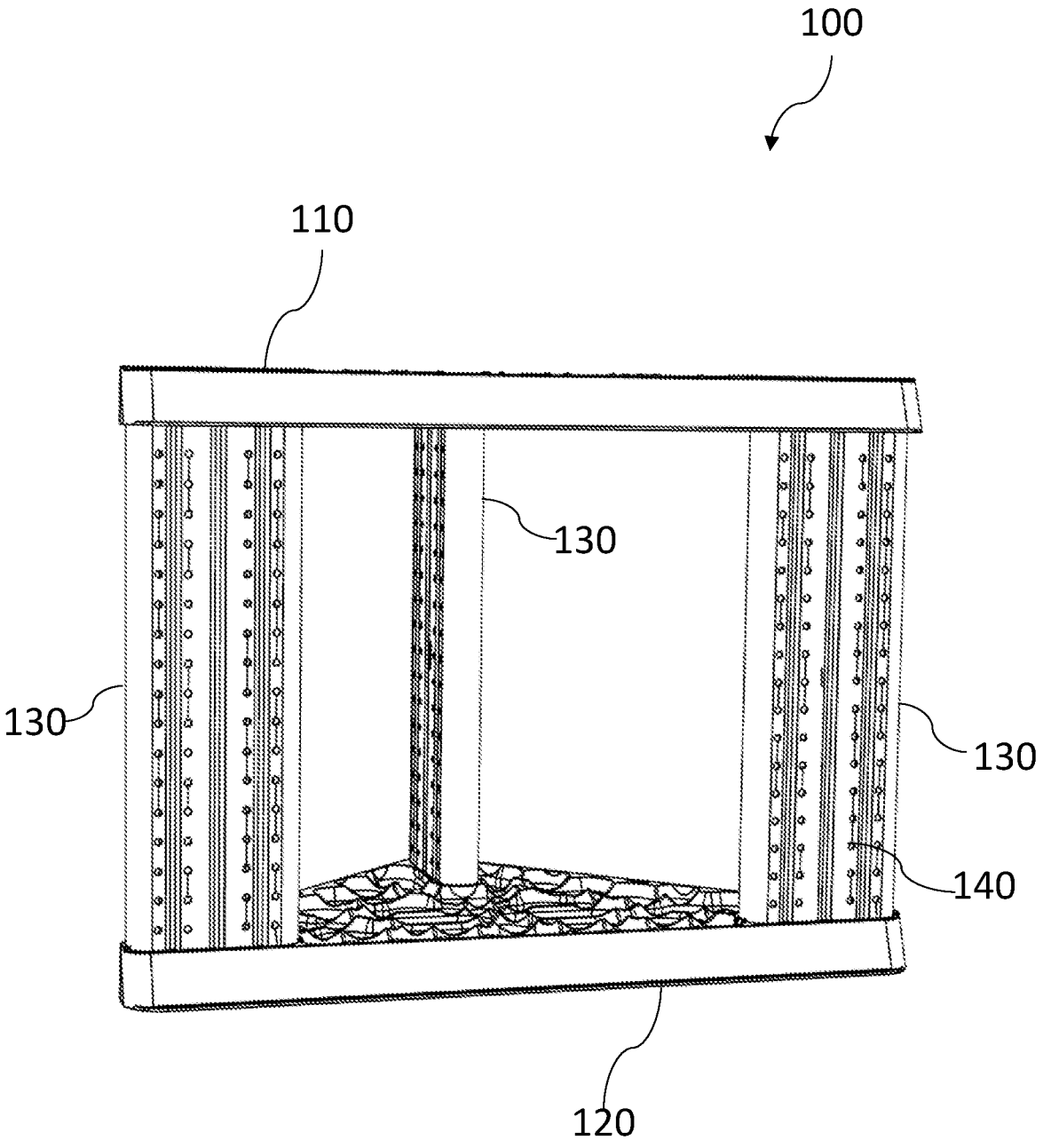
FIG. 1 is a perspective view of the disclosed apparatus for storing and organizing utility tools, according to an exemplary embodiment of the present invention.
Figure 2:
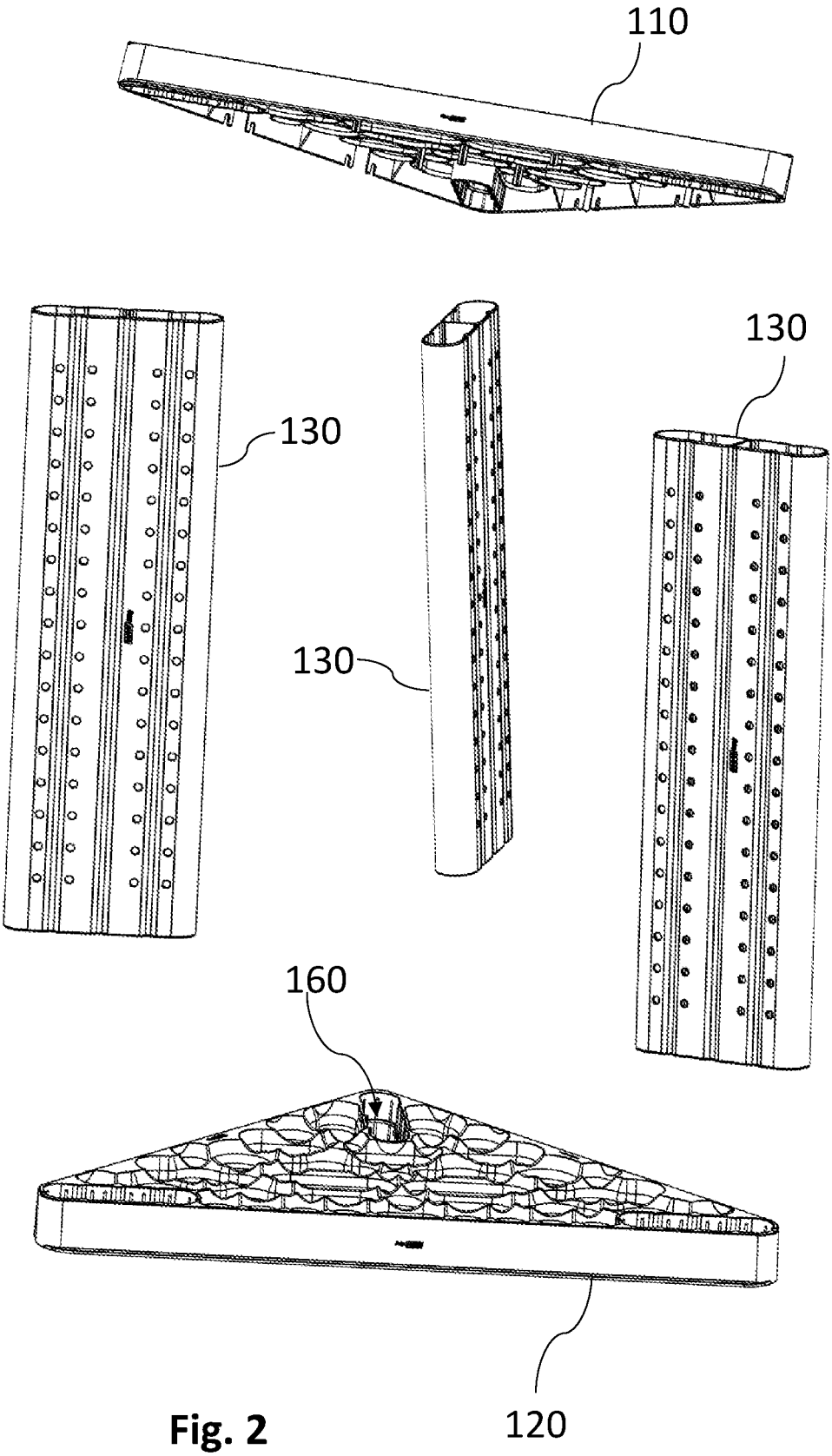
FIG. 2 is an exploded view of the apparatus showing the two panels and the three pillars, according to an exemplary embodiment of the present invention.
Figure 6:
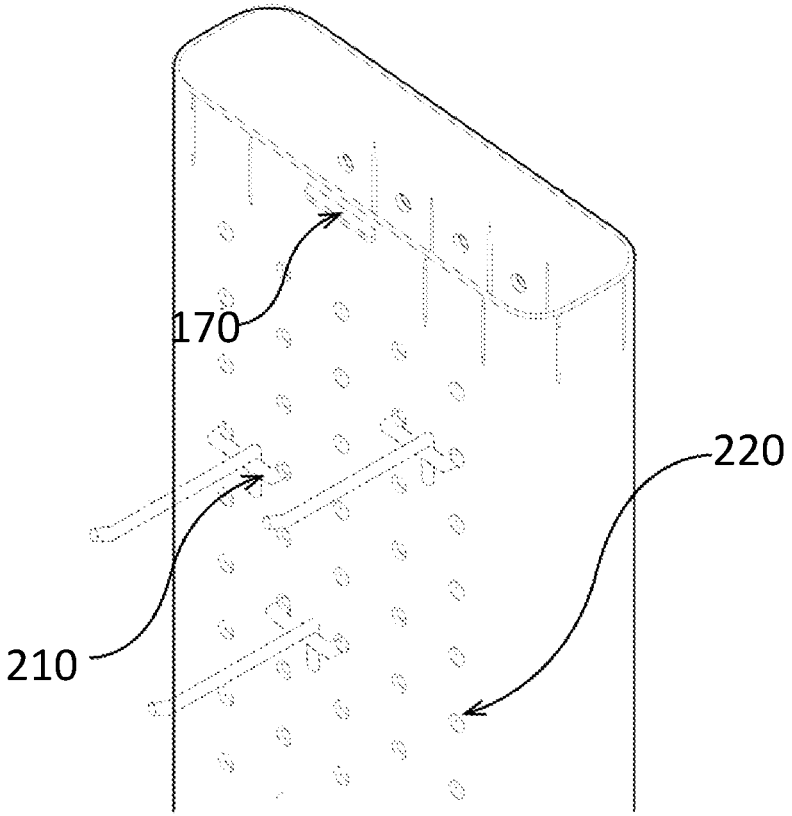
FIG. 6 is a perspective view of a pillar in the form of a pegboard in which hooks are mounted for small and medium-sized tools, according to an exemplary embodiment of the present invention.

Disclosed is an apparatus for storing utility tools in an organized manner, and in particular, the tools with long handles. Disclosed apparatus allows more tools to be stored in less space. Moreover, the stored tools are stable and do not fall by normal nudges and shocks. Referring to FIG. 1 which is a perspective view of the disclosed apparatus 100. Apparatus 100 includes an upper panel 110 and a lower panel 120 and three pillars 130 that extend between the upper panel and the lower panel. FIG. 2 is an exploded view of the apparatus 100 shown in FIG. 1. FIG. 2 shows the upper panel 110, the lower panel 120, and the three pillars 130. Each of the three pillars is of an elongated tubular profile which is wide and hollow. Each pillar resembles a pegboard having several apertures 140. Each pillar 130 having a proximal end and a distal end. The proximal end can be received into a locking channel 150 of the upper panel 110. Similarly, the distal end of pillar 130 can be received into the locking channel 160 of the lower panel 120. The length of the locking channels could be sufficient to stabilize the disclosed apparatus 100. Preferably, the pillars can be coupled to the upper panel and the lower panel through friction fit mechanism. The pillars can frictionally fit into the locking channels. Alternatively, each pillar can be secured to the upper panel and the lower panel through a fastening mechanism, such as the pillar can snap-fit into the locking channels of the upper panel and the lower panel. FIG. 6 shows the pillar having at its proximal end a longitudinal protrusion 170 that can snap-fit into a longitudinal groove made in the locking channel. The proximal end of the pillar can have one such protrusion or two protrusions on the opposite faces of the pillar. Similarly, the distal end of each pillar can also have one or two such protrusions. A third panel can also be provided above the upper panel for vertically expanding the disclosed apparatus. Similar three pillars can support the third panel onto the upper panel, wherein the three pillars can engage into the locking channels 150 of the upper panel 110. Each locking channel can receive two pillars from its opposite ends. Higher apparatuses may be needed for still longer tools.

Figure 3:
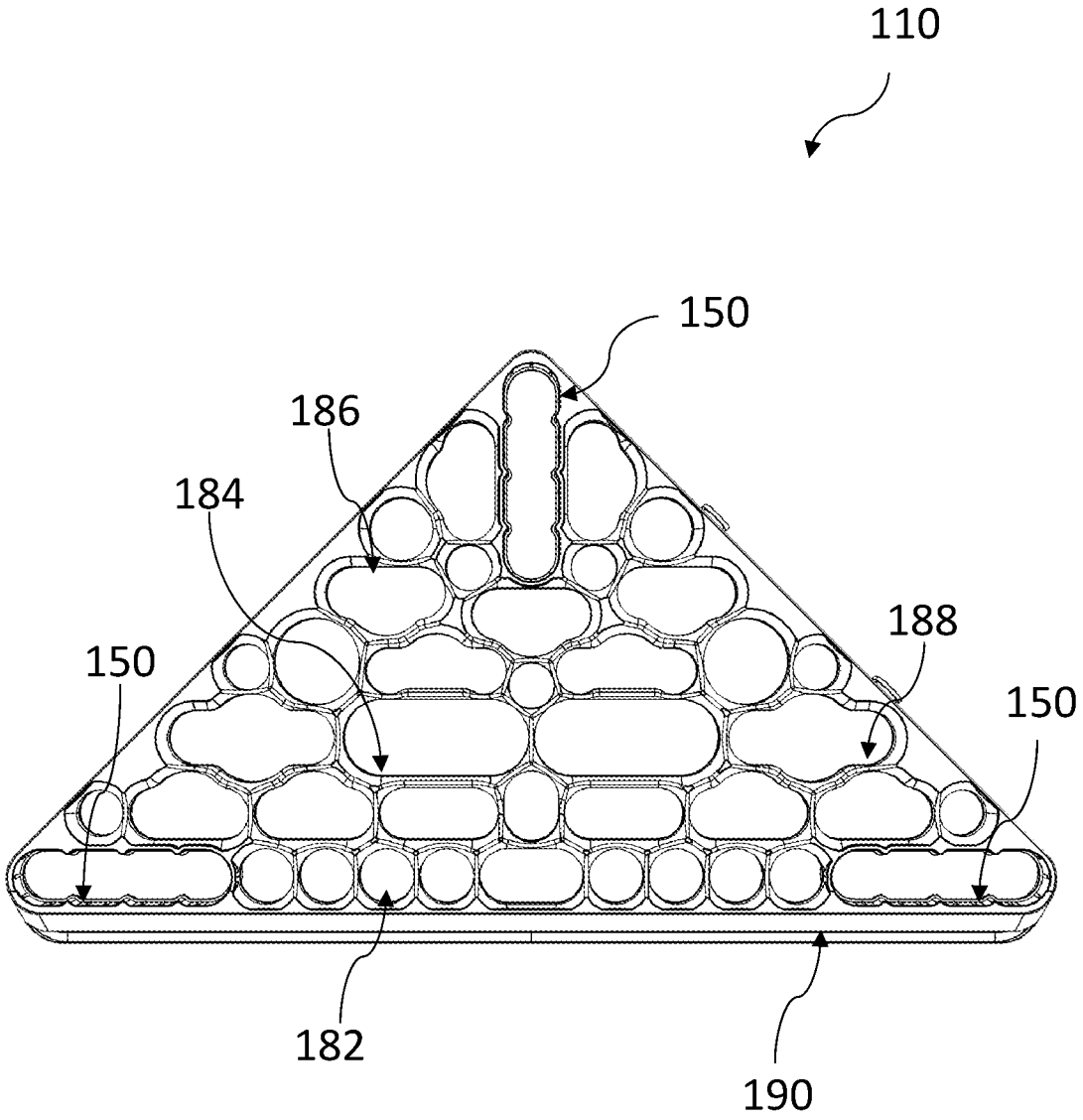
FIG. 3 is a top view of the apparatus showing the voids of different shapes for receiving a range of utility tools with varying shapes and dimensions, according to an exemplary embodiment of the present invention.

Referring to FIG. 3 which shows the top view of the apparatus 100. The voids in the upper panel 110 can be seen in FIG. 3. The lower panel 120 can be the same as the upper panel 110. In the upper panel 110 can be seen three voids equally spaced from each other, these are the locking channels 150 for mounting the pillars. Other voids in the upper panel can be for receiving the tools. It can be seen that the few voids are round voids 182. On one side of the upper panel can be seen oblong voids 184. Cloud shape voids 186 can also be seen in the upper panel. The cloud shape voids having an oblong shape with one elongated shape expanded outwards in a semicircle shape. Additionally, oblong voids 188 having a broad circular middle portion can also be provided in the upper panel. The front side 190 of the upper panel can be sloped outwards such as to stabilize the apparatus. For example, the inclined tools in the apparatus can be destabilizing, wherein the sloped edge 190 tends to stabilize the apparatus. Different shapes and dimensions of the voids allow receiving a range of tools of different dimensions and shapes.

Figure 4:
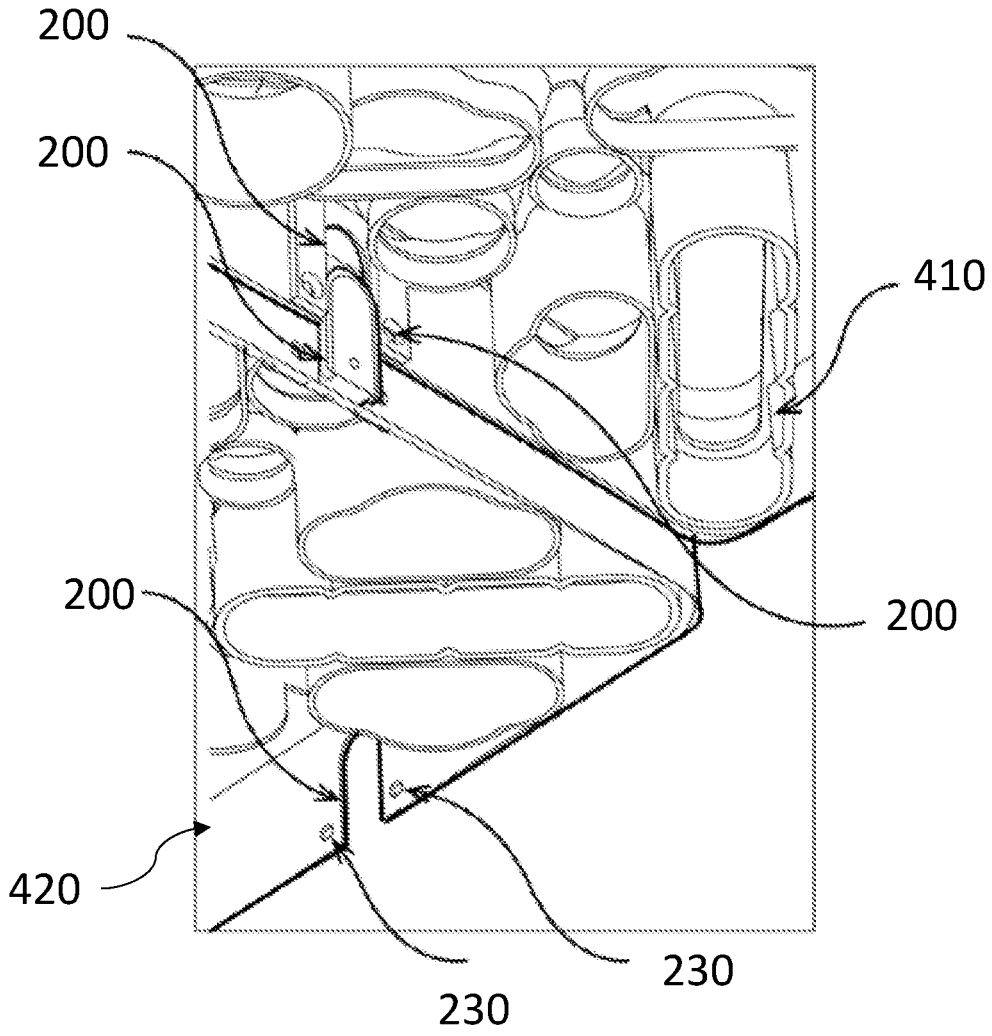
FIG. 4 shows an assembly formed by assembling two apparatuses side-by-side to expand the storage capacity, according to an exemplary embodiment of the present invention.
Figures 5A, 5B, 5C:
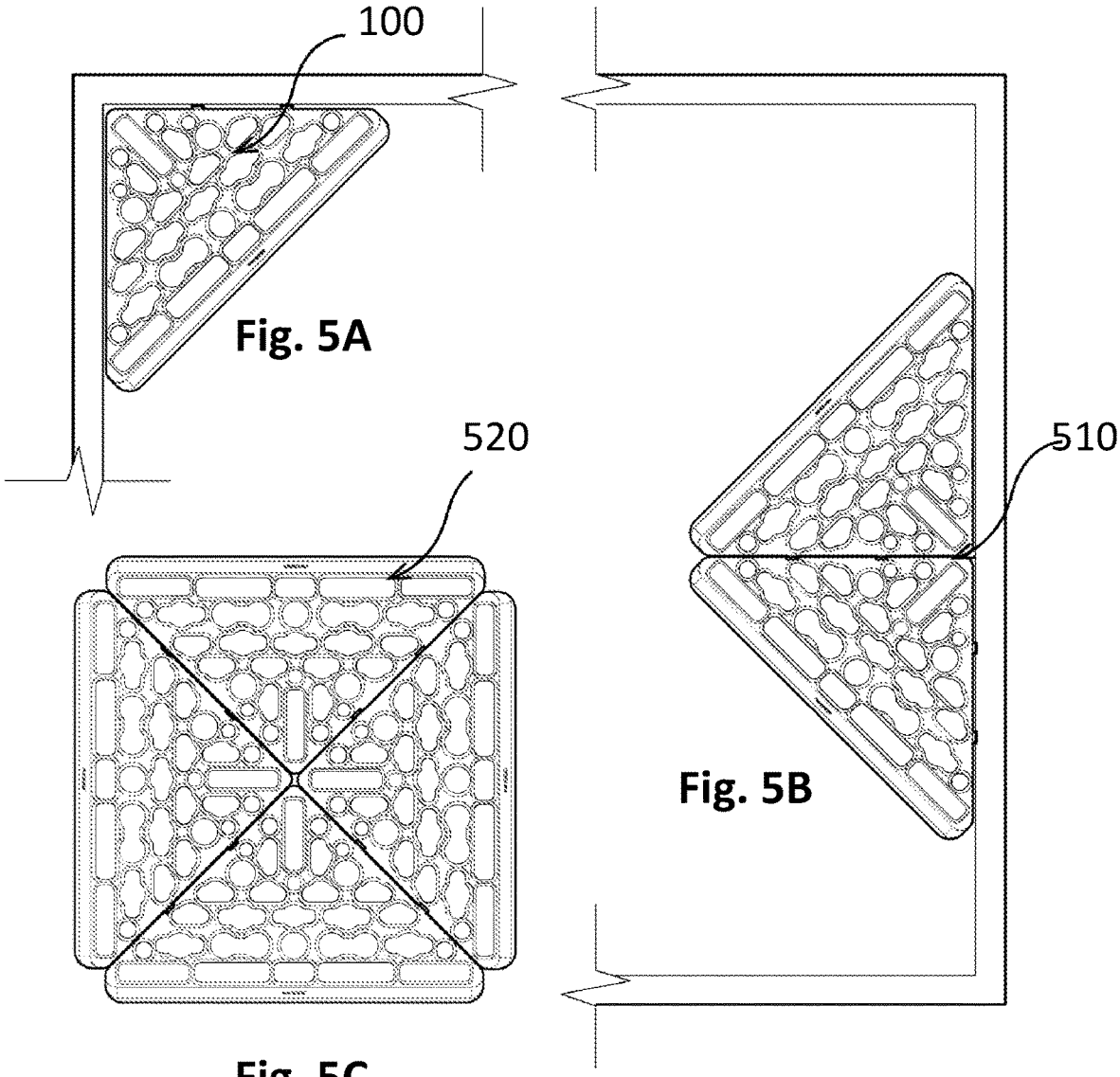
FIG. 5A is a plan view showing an exemplary arrangement of the apparatus in corer, according to the present invention.
FIG. 5B is a plan view showing assembly having two units of apparatus supported against a wall, according to an exemplary embodiment of the present invention.
FIG. 5C is a plan view showing the assembly made by four units of apparatuses that can be freestanding, according to an exemplary embodiment of the present invention.

Referring to FIG. 4 which shows the two apparatuses 410 and 420 joined side-by-side as units of a bigger assembly. The storage capacity of the apparatus can be expanded by combining two or more apparatuses as units. Clips 200 can be provided on the sides of the upper panel and the lower panel that allows an apparatus to be joined with another apparatus. The clips can be based on hook mechanism, friction fit mechanism, or snap fit mechanism. FIG. 1 shows the apparatus of a triangular shape having three sides. Such an apparatus can be easily stowed in a corner of a building, such as in a garage. Moreover, two such units can be combined side-by-side to increase the storing capacity. Such a double unit assembly can be stowed against a wall. Moreover, four units of the apparatus can be combined to form a large square shape assembly. FIG. 4 also shows holes 230 that can be used to secure the two units of apparatus though fasteners, such as nut and bold. FIG. 5A shows the apparatus of FIG. 1 stowed in a corner. FIG. 5B shows an assembly 510 having the two units of the apparatus combined and stowed against a wall. FIG. 5C shows the assembly 520 having four units of apparatus combined to form a square shape free-standing assembly that can be stowed in a corner, against a wall, or any open space in a room. It is to be understood that more than four units of the disclosed apparatuses can also be combined to increase the capacity, for example in shops, multiple units can be combined for more capacity.

Figure 7:
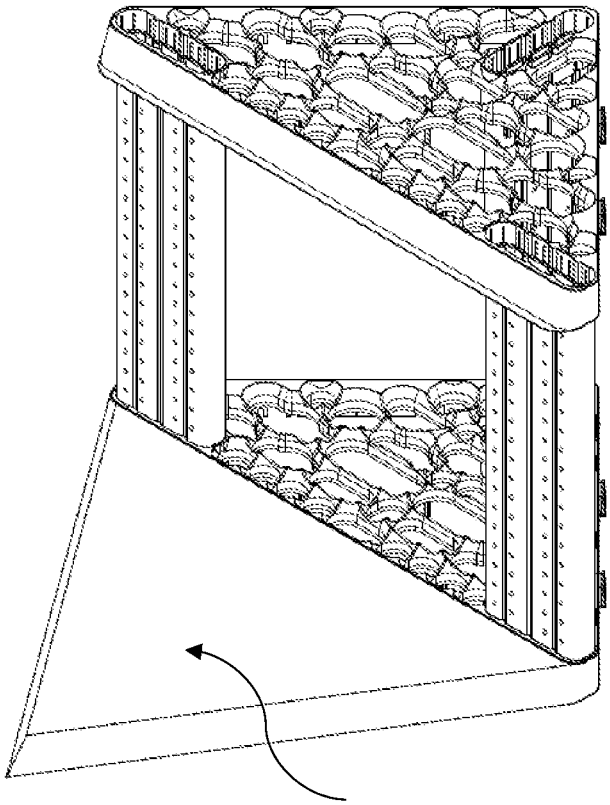
FIG. 7 shows the apparatus having a lip extending from the lower panel, according to an exemplary embodiment of the present invention.

Referring to FIG. 6 which shows hooks 210 mounted in the apertures 220 of pillar. The pillar can be a pegboard with multiple holes in which hooks can be mounted. Multiple articles including small and medium-sized tools can then be mounted on these hooks. Referring to FIG. 7 which shows a lip 710 extending from lower panel of the apparatus. The lip 710 may allow for smaller hand tools to rest there for easier access. This lip also allows for increased floor support.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An apparatus for storing utility articles, the apparatus comprises:

an upper panel;

a lower panel; and three or more pillars extend between the upper panel and the lower panel, the three of more pillars are rectangular with two short sides rounded, each of the three or more pillars having several peg holes configured to receive one or more hooks, wherein each the upper panel and the lower panel has three or more locking channels to snugly receive ends of the three or more pillars, each locking channel of the three of more locking channels configured to receive two pillars at top and bottom, wherein each the upper panel and the lower panel having a plurality of voids to receive long-handle tools, one or more voids of the plurality of voids are round and one or more voids of the plurality of voids are of an oblong shape, wherein each the upper panel and the lower panel are having three sides, and three pillars extend between the upper panel and the lower panel, one of the three sides is sloped outwards, the sloped side configured to stabilize the apparatus, two adjacent sides of the three sides other than the sloped side are having fastening members, the fastening members configured to permit the apparatus to couple side-by-side with another apparatus.

2. The apparatus according to claim 1, wherein the fastening members based on friction fit mechanism.

3. The apparatus according to claim 1, wherein each of the one or more hooks is supported on three or more peg holes in the pillar.

4. The apparatus according to claim 1, wherein each pillar having a proximal end and a distal end, each the proximal end and the distal end having a male part of a fastening member, each of the three or more locking channels of the upper panel and the lower panel having a female part of the fastening member, the male part can snap-fit into the female part.

5. The apparatus according to claim 1, wherein the apparatus further comprises a third panel mounted above the upper panel, three or more second pillars extend between the upper panel and the third panel.

6. The apparatus according to claim 5, wherein the three or more locking channels of the upper panel configured to receive the three or more second pillars.

7. An assembly comprising a plurality of units, each unit comprising:

an upper panel having three sides;

a lower panel having three sides, two adjacent sides of the three sides of the upper panel and the lower panel having a plurality of clips for side-by-side coupling of two units; and three or more pillars that extend between the upper panel and the lower panel, each of the three or more pillars having several holes configured to receive one or more hooks, wherein each the upper panel and the lower panel having three or more locking channels to snugly receive ends of the three or more pillars, wherein each the upper panel and the lower panel having a plurality of voids to receive long-handle tools, one or more voids of the plurality of voids are round, one or more voids of the plurality of voids are of an oblong shape, wherein one of the three sides other than the two adjacent sides of the upper panel and the lower panel are sloped outwards for stabilizing the unit, both sloped sides are adjacent to each other, wherein four unit are combined by the plurality of clips to form a square shape assembly, wherein the sloped sides form an outer periphery of the square shape assembly.

8. The apparatus according to claim 1, wherein one side of the one of the three sides has a lip extending outwards and configured to stabilize the apparatus on a floor.

* * * * *